US011346336B2

(12) United States Patent
Surjaatmadja et al.

(10) Patent No.: US 11,346,336 B2
(45) Date of Patent: May 31, 2022

(54) SAFETY PRESSURE LIMITING SYSTEM AND METHOD FOR POSITIVE DISPLACEMENT PUMPS WITH OPTIONAL AUTOMATIC RESTART

(71) Applicant: Halliburton Energy Services, Inc., Houston, TX (US)

(72) Inventors: Jim Basuki Surjaatmadja, Duncan, OK (US); Stanley V. Stephenson, Duncan, OK (US); Tim H. Hunter, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 188 days.

(21) Appl. No.: 16/753,652

(22) PCT Filed: Dec. 4, 2017

(86) PCT No.: PCT/US2017/064534
§ 371 (c)(1),
(2) Date: Apr. 3, 2020

(87) PCT Pub. No.: WO2011/112554
PCT Pub. Date: Jun. 13, 2019

(65) Prior Publication Data

US 2020/0256333 A1 Aug. 13, 2020

(51) Int. Cl.
*F04B 15/02* (2006.01)
*F04B 49/03* (2006.01)
(Continued)

(52) U.S. Cl.
CPC ..... *F04B 49/065* (2013.01); *F04B 15/02* (2013.01); *F04B 49/03* (2013.01); *F04B 23/06* (2013.01);
(Continued)

(58) Field of Classification Search
CPC ..... F04B 49/065; F04B 15/02; F04B 49/03; F04B 23/06; F04B 53/10; F04B 2205/03
See application file for complete search history.

(56) References Cited

U.S. PATENT DOCUMENTS 5,924,774 A 7/1999 Cook et al.
6,535,827 B1 3/2003 Lestina et al.
(Continued)

FOREIGN PATENT DOCUMENTS

DE 10 2013203822 A1 9/2014
EP 0402871 B1 4/1996
JP 2001-164913 A 6/2001

OTHER PUBLICATIONS

International Search Report and Written Opinion issued in related PCT Application No. PCT/US2017/064534 dated Aug. 29, 2018, 18 pages.
(Continued)

*Primary Examiner* — Patrick Hamo
(74) *Attorney, Agent, or Firm* — Conley Rose, P.C.; Rodney B. Carroll

(57) ABSTRACT

Certain conditions or triggering events require preventing or throttling the discharge of a servicing fluid from a pump to a wellhead or a borehole. Powering down may not be desirable or may require a duration that allows the condition or triggering event to persist. Selectively and automatically activating one or more pressure control valves may throttle or prevent the servicing fluid from being pumped from the pump during the power down sequence or without requiring a power down sequence. Selective activation of a pressure control valve may introduce pressurized fluid into a cylinder of the pump extending a rod to force or maintain a suction valve in an open position. While the suction valve is in the open position, the stroke of the plunger may not create
(Continued)

enough pressure to pump the servicing fluid causing the servicing fluid to flow between a fluid header and a chamber of the pump.

19 Claims, 6 Drawing Sheets

(51) Int. Cl.

| | |
|---|---|
| ***F04B 49/06*** | (2006.01) |
| *F04B 23/06* | (2006.01) |
| *F04B 49/22* | (2006.01) |
| *F04B 53/10* | (2006.01) |

(52) U.S. Cl.
CPC ..... *F04B 49/22* (2013.01); *F04B 53/10* (2013.01); *F04B 2201/0201* (2013.01); *F04B 2205/03* (2013.01)

(56) References Cited

U.S. PATENT DOCUMENTS

| | | | | |
|---|---|---|---|---|
| 6,619,388 | B2 * | 9/2003 | Dietz | E21B 34/066 166/332.8 |
| 6,676,831 | B2 | 1/2004 | Wolfe | |
| 7,255,539 | B1 * | 8/2007 | Kunkier | F04D 15/0066 417/34 |
| 2009/0041588 | A1 * | 2/2009 | Hunter | F04B 7/0076 417/27 |
| 2010/0186209 | A1 | 7/2010 | Younger | |
| 2013/0014499 | A1 | 1/2013 | Gray, Jr. | |
| 2013/0081715 | A1 | 4/2013 | McCormick et al. | |
| 2014/0110612 | A1 | 4/2014 | Bao et al. | |
| 2015/0292297 | A1 | 10/2015 | Kajaria et al. | |
| 2016/0177683 | A1 | 6/2016 | Hodges et al. | |
| 2017/0074079 | A1 | 3/2017 | Elmer | |
| 2017/0234485 | A1 | 8/2017 | Navarre, II | |
| 2018/0163717 | A1 * | 6/2018 | Jarchau | F02M 63/0028 |
| 2020/0309113 | A1 * | 10/2020 | Hunter | F04B 1/053 |

OTHER PUBLICATIONS

Office Action issued in related Canadian Patent Application No. 3,076,804 dated Jun. 4, 2021, 3 pages.

International Preliminary Report on Patentability issued in related PCT Application No. PCT/US2017/064534 dated Jun. 18, 2020, 14 pages.

Office Action issued in related Canadian Patent Application No. 3,076,804 dated Dec. 22, 2021, 6 pages.

* cited by examiner

SAFETY PRESSURE LIMITING SYSTEM AND METHOD FOR POSITIVE DISPLACEMENT PUMPS WITH OPTIONAL AUTOMATIC RESTART

CROSS-REFERENCE TO RELATED APPLICATION

The present application is a U.S. National Stage Application of International Application No. PCT/US2017/064534 filed Dec. 4, 2017, which is incorporated herein by reference in its entirety for all purposes.

TECHNICAL FIELD

The present disclosure relates generally to a controlled stop for a pump and, more particularly, to selective and automatic pressure limiting for a pumping system, for example, pumps used for well stimulation.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

Positive displacement pumps, for example, reciprocating pumps, are used in all phases of well servicing operations including to pump water, cement, fracturing fluids, and other stimulation or servicing fluids as well as other pumping operations. During a well service operation, a condition may occur (for example, an overpressure condition) or a test may be desired to be ran that requires a rapid or substantially instantaneous stop of an operational pump to control the amount of pressurized fluid flowing to a wellhead. For pumps driven by a diesel engine, the transmission could disengage the clutch and power to the pump would be stopped causing the pump to stop substantially instantaneously. For pumps driven by an electric motor or powertrain, however, kinetic energy stored in the rotor is so high such that it can cause damage to the electric motor or power train, other structures or the surrounding environment if the electric motor or powertrain is shutdown too quickly. Additionally, control links or communications links may be broken or down, for example, due to software issues or communication breakdown between control systems and the network, resulting in a transmission being stuck in gear or an automatic pressure control not being activatable. Current safety controls or measures generally shut an entire pumping system or operation down until an overpressure mechanism, such as a valve or rupture disc, is reset or replaced. Such measures result in increase in costs and increase the duration of the operation.

BRIEF DESCRIPTIONS OF THE DRAWINGS

Some specific exemplary embodiments of the disclosure may be understood by referring, in part, to the following description and the accompanying drawings.

Figure 1:
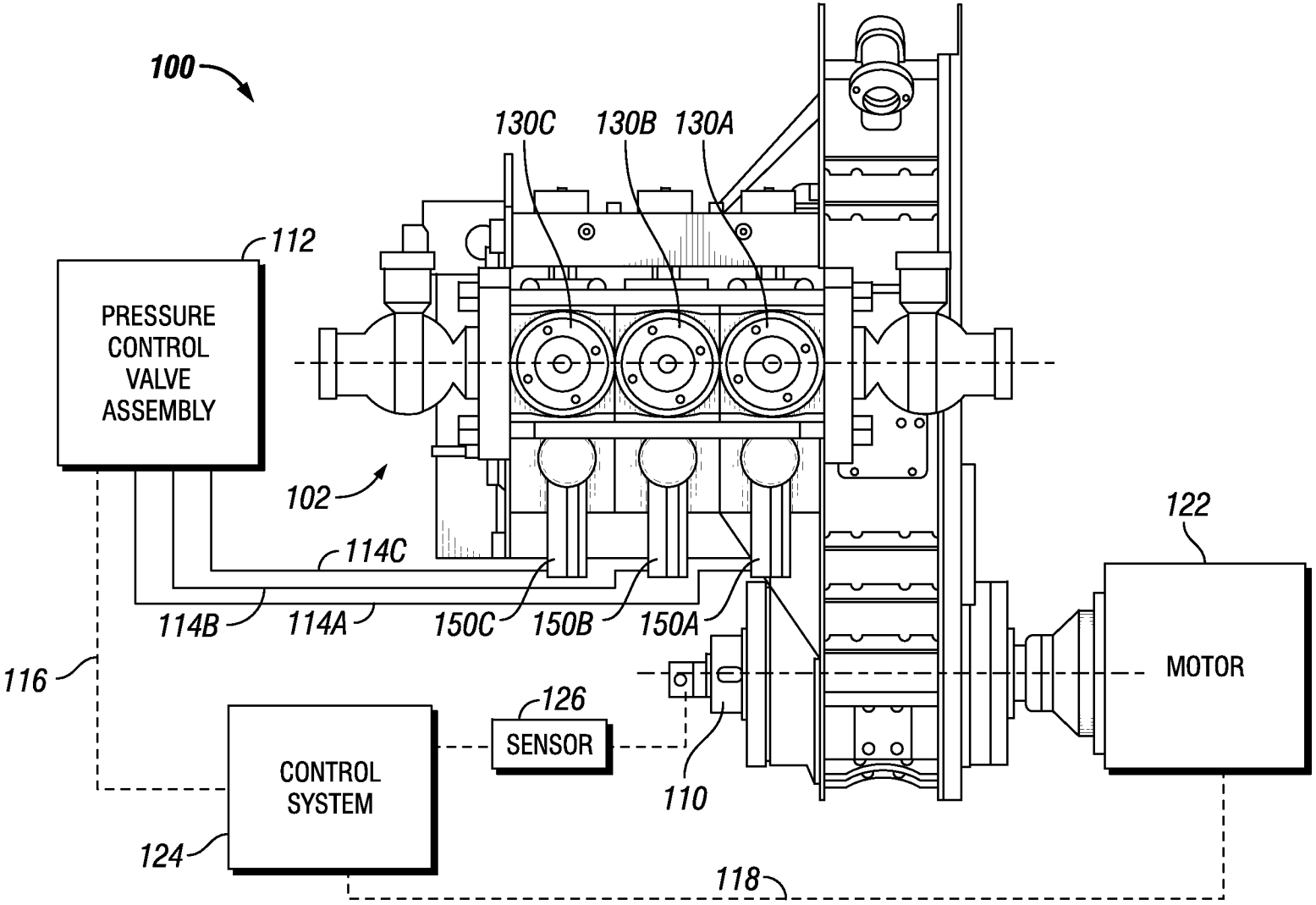
FIG. 1 is a front view illustrating a controllable pumping system, according to one or more aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

The present disclosure relates generally to a selective, automatic or both controlled stop for a pump of a pumping system and, more particularly, to selective and automatic control of high horsepower, direct drive, electric pumps, for example, pumps used for well stimulation to mitigate an event, such as an overpressure event. Generally, diesel engines may be used to drive one or more pumps, for example, one or more pumps for performing well servicing operations such as stimulating a wellbore. Conditions at the well site may require that any one or more pumps be stopped immediately or substantially instantaneously to prevent damage to the pump, the motor or powertrain driving the pump, surrounding equipment or environment. For example, an overpressure condition may occur or an operator may require that one or more tests be ran. With a diesel engine, the clutch could be disengaged from the transmission stopping substantially instantaneously the driving of the pump. However, diesel engines may not be suitable for a given well site environment due to operational characteristics of the diesel engine, for example, control over pump rate, exhaust emissions and noise emissions. An electric motor or powertrain may provide the operational characteristics required for a given well site environment. However, electric motors or powertrains comprise a rotor that may have substantial weight that is not easily stopped or instantaneously controlled during operation without causing damage to the equipment. Further, emergency relief valves or other mechanisms may not be resettable without replacement or recertification or a costly amount of time. Thus, one or more aspects of the present disclosure provide for selectively, automatically, or both controlling the pump rate of fluid from the downstream pressurized fluid system (for example, the pump) without overpressuring the downstream pressurized fluid system where the pump rate can be reactivated without signification down time or undue delay so as to control costs and maximize efficiency of a system. For example, the response or mitigation step to a condition or triggering event, such as an overpressure event, may be temporary such that normal operation of the system (such as a pump) may be resumed automatically.

In one or more aspects of the present disclosure, a well site operation may utilize an information handling system to control one or more operations including, but not limited to, a motor or powertrain, a downstream pressurized fluid system, or both. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. The information handling system may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a sequential access storage device (for example, a tape drive), direct access storage device (for example, a hard disk drive or floppy disk drive), compact disk (CD), CD read-only memory (ROM) or CD-ROM, DVD, RAM, ROM, electrically erasable programmable read-only memory (EEPROM), and/or flash memory, biological memory, molecular or deoxyribonucleic acid (DNA) memory as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions must be made to achieve the specific implementation goals, which will vary from one implementation to another. Moreover, it will be appreciated that such a development effort might be complex and time-consuming, but would nevertheless be a routine undertaking for those of ordinary skill in the art having the benefit of the present disclosure.

Throughout this disclosure, a reference numeral followed by an alphabetical character refers to a specific instance of an element and the reference numeral alone refers to the element generically or collectively. Thus, as an example (not shown in the drawings), widget "1*a*" refers to an instance of a widget class, which may be referred to collectively as widgets "1" and any one of which may be referred to generically as a widget "1". In the figures and the description, like numerals are intended to represent like elements.

To facilitate a better understanding of the present disclosure, the following examples of certain embodiments are given. In no way should the following examples be read to limit, or define, the scope of the disclosure. Embodiments of the present disclosure may be applicable to drilling operations that include but are not limited to target (such as an adjacent well) following, target intersecting, target locating, well twinning such as in SAGD (steam assist gravity drainage) well structures, drilling relief wells for blowout wells, river crossings, construction tunneling, as well as horizontal, vertical, deviated, multilateral, u-tube connection, intersection, bypass (drill around a mid-depth stuck fish and back into the well below), or otherwise nonlinear wellbores in any type of subterranean formation. Embodiments may be applicable to injection wells, and production wells, including natural resource production wells such as hydrogen sulfide, hydrocarbons or geothermal wells; as well as borehole construction for river crossing tunneling and other such tunneling boreholes for near surface construction purposes or borehole u-tube pipelines used for the transportation of fluids such as hydrocarbons. Embodiments described below with respect to one implementation are not intended to be limiting.

FIG. 1 is a front view of a controllable pumping system 100, according to one or more aspects of the present disclosure. Pumping system 100 comprises a pump 102, for example, a positive displacement pump, with valve interrupt or deactivation systems 150*a*, 150*b* and 150*c* (collectively, valve system 150). While three valve systems 150*a*, 150*b* and 150*c* are illustrated, pumping system 100 may comprise any one or more valve systems 150. A pump 102 may comprise multiple chambers 130*a*, 130*b* and 130*c* (collectively, chamber 130) with plungers driven by a single crankshaft 110. By way of example only, pump 102 as illustrated comprises three chambers 130 connected to a common crankshaft 110. Each valve system 150 of pump 102 may be coupled to a pressure control valve assembly 112. In one or more embodiments, any one or more valve systems 150 may be coupled to any one or more pressure control valve assemblies 112. For example, pressure control valve assembly 112 may couple via control lines 114*a*, 114*b* and 114*c* (collectively, control lines 114) to valve systems 150*a*, 150*b* and 150*c*, respectively. Control lines 114 flow a pressurized fluid (for example, pressurized fluid 218 of FIG. 2) to activate or deactivate (or actuate and deactuate) the valve system 150. For each chamber 130 of pump 102, the crankshaft 110 drives a plunger (see, for example, plunger 220 in FIG. 2) located within the chamber 130. The chamber 130 includes a suction valve (for example, suction valve 237 in FIG. 2)) and a discharge valve (for example, discharge valve 239 in FIG. 2). The suction valve connects a servicing fluid source to pump 102. Pump 102 pressurizes the servicing fluid and pumps or discharges the servicing fluid via a flow line (for example, flow line 222 in FIG. 2) to a desired location. Servicing fluid source may comprise any type of servicing fluid for any type of application. For example, in a well servicing application, a servicing fluid may comprise a well servicing fluid that may include, but is not limited to, any one or more of water, fracturing or stimulation fluid, mud, slurry, and any other fluid required to be pumped to a wellbore or downhole.

The pump 102 is coupled to a motor (or powertrain) 122 that drives the crankshaft 110 for powering the pump 102. In one or more embodiments, the motor 122 comprises an electric motor. The motor 122 may be coupled to a control system 124 via a control line 118. Control system 124 may control activation and deactivation of the pressure control valve assembly 112 via a control signal 116 and the speed of the motor 122 via a control signal 118. In one or more embodiments, any one or more pressure control valve assemblies 112 may be coupled to any one or more control systems 124. Control system 124 may be coupled to a sensor 126 that couples to the pump 102 to measure one or more characteristics of the pump 102. In one or more embodiments, control system 124 may comprise any one or more information handling systems and may be directly or indirectly coupled to any one or more components of the pumping system 100. In one or more embodiments, each of a plurality of control systems 124 may be communicatively coupled to each other and may be coupled to one or more different components of pumping system 100. In one or more embodiments, control system 124 is located remotely from the pumping system 100. In one or more embodiments, control system 124 is located local to the pumping system 100.

Figure 2:
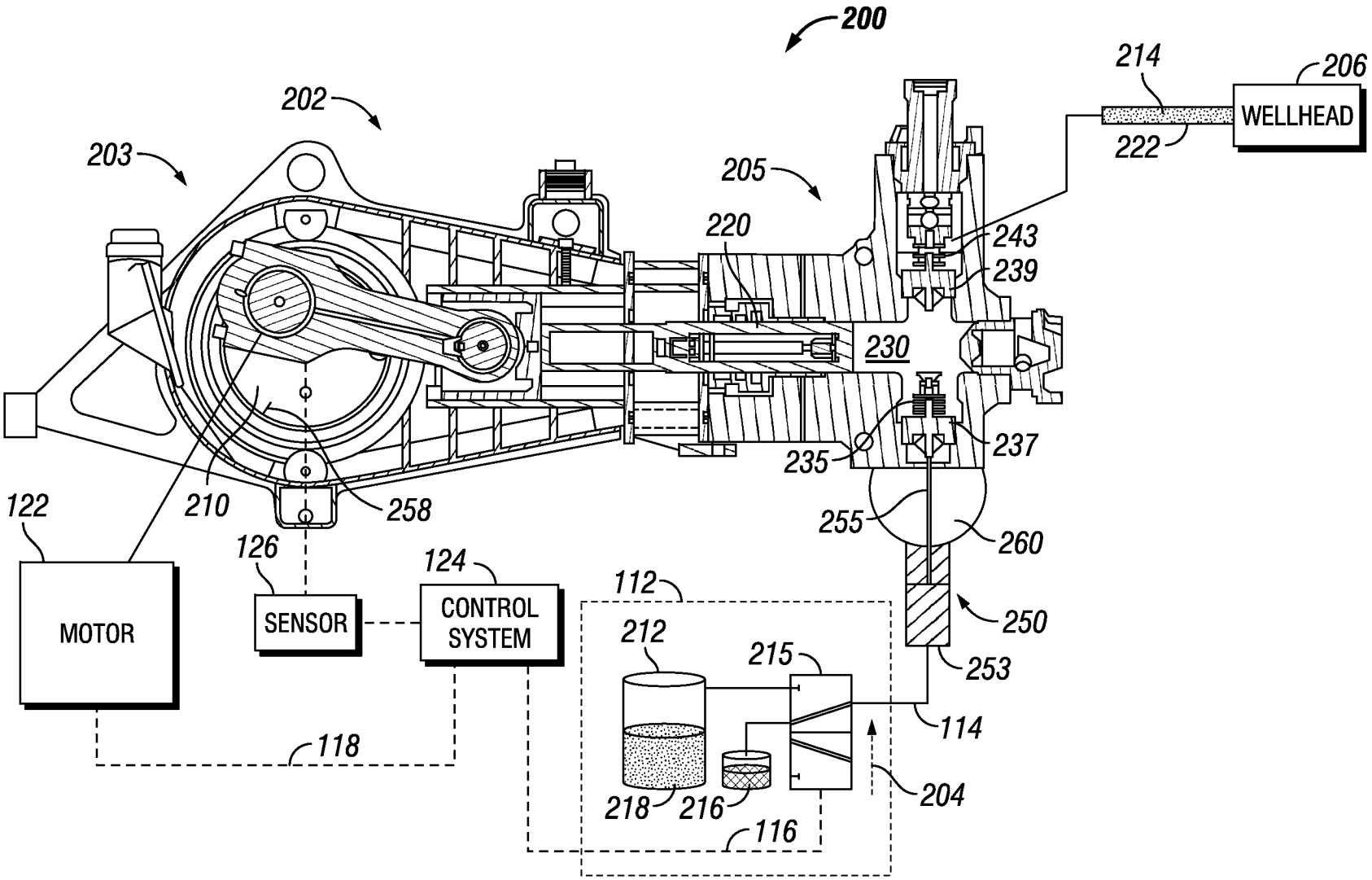
FIG. 2 is a cross-section illustrating a representative chamber in a pump of a controllable pumping system, according to one or more aspects of the present disclosure.

FIG. 2 is a cross-section of a representative chamber 230 in a pump 202 of a controllable pumping system 200, according to one or more aspects of the present disclosure. Pump 202 comprises a positive displacement pump. Pump 202 comprises a power end 203 that includes a crankshaft 210 that drives the plunger 220 and a fluid end 205 that includes a compression chamber 230 into which servicing fluid 214, for example well servicing fluid, flows through the suction valve 237 to be pumped out through the discharge valve 239 under pressure as the plunger 220 extends into the chamber 230. The suction valve 237 and the discharge valve 239 may be any type of valve, actuator, flap, gate, inlet, tap, faucet, any other type of device which controls the flow of a fluid, or any combination thereof. Pump 202 comprises a valve train 250 that provides a force directed to open the suction valve 237, a sensor 126 for detecting pump stroke position, velocity or both (for example, based on a location of timing marker 258) and a control system 124.

Control system 124 may receive information (for example, pump stroke information) from the sensor 126. Control system 124 may be coupled to the pressure control valve assembly 112. Pressure control valve assembly 112 may comprise one or more pressure control valve assemblies. The pressure control valve assembly 112 may be coupled to the valve train 250. In one or more embodiments, one or more pressure control valve assemblies 112 may be coupled to any one or more valve trains 250. The pressure control valve assembly 112 may activate or deactivate the valve train 250 based, at least in part, on a control signal 116 from the control system 124. For example, control system 124 may send a control signal 116 to pressure control valve assembly 112 based on the received information. For a multi-chamber pump, any one or more sensors 126 and one or more control systems 124 may operate or the pressure control valve assembly 112 for each valve train 250 associated with each chamber 230. In one or more embodiments, each chamber 230 is associated with a different sensor 126, a different control system 124, or both. In one or more embodiments, any one or more chambers 230 may be associated with any one or more sensors 126, any one or more control systems 124, or both. In one or more embodiments, the valve train 250 may be controlled automatically, manually or mechanically. In one or more embodiments, control signal 116 may be coupled directly to sensor 126.

The valve train 250 comprises a cylinder 253 with a rod 255 interacting with the suction valve 237 of the pump 202. The cylinder 253 that drives the rod 255 to operate the suction valve 237 may be hydraulic, pneumatic (or powered by some other gas) or electric or any other suitable type of cylinder. Rod 255 provides a force when extended on the suction valve 237 causing the suction valve to open (for example, by pushing the suction valve 237 from a seat of the suction valve 237). The valve train 250 may provide a force that opens the suction valve 237. During a discharge or compression stroke, pressure inside the chamber 230 is high keeping suction valve 237 closed. Forces created by valve train 250 are generally not sufficient to counteract this closure force during the discharge stroke. As soon as the plunger 220 retracts, pressure inside the chamber 230 lowers or becomes very low and suction valve 237 opens. At this time the rod 255 may extend based on control line 114 which prevents the suction valve 237 from closing and disables the pump 202 or prevents the pumping of servicing fluid 214 from the pump 202. Output flow of the pump 202 via flow line 222 is therefore ceased or stopped completely, even though any one or more mechanisms of the pump 202 continue to operate. As commonly known in the art, forces created by the valve train 250 must be greater than the suction valve spring 235 forces in addition to forces caused by the fluid flow rushing past the suction valve 237. As the pump 202 is disabled or no longer pumping, the motor 122 may be ramped down or stopped gradually without causing any damage to the motor 122, the pump 202 or any other equipment or surrounding environment.

A closure member of the valve train 250 may provide the closing force to the suction valve 237. A closure member may include, but is not limited to, suction valve spring 235, compressed gas (such as air) cylinder, a hydraulic system with gas-filled accumulator, a gravity or buoyancy based closure member, or any combination thereof. In one or more embodiments, the suction valve spring 235 is compressed as the suction valve 237 opens which provides a closing force on the suction valve 237. As the rod 255 extends (when the valve train 250 provides an opening force to the suction valve 237), the suction valve spring 235 resists in compression (since the suction valve is biased closed by the suction valve spring 235). When the valve train 250 releases the opening force (by the rod 255 retracting, for example) during the discharge stroke, the suction valve spring 235, fluid flow or both provide a force directed to close the suction valve 237 (a closing force).

In the embodiment of FIG. 2, the cylinder 253 is mounted to the fluid header 260. In or more embodiments, a cylinder 253 of a pump valve system may provide pulling forces or even rotary forces as needed. The fluid header 260 brings servicing fluid 214 to be pumped by the pump 202 from a fluid source to the suction valve 237, and the rod 255 extends through an appropriately sealed opening in the fluid header 260 to interact mechanically with the suction valve 237. As the rod 255 extends, it provides a force to open the suction valve 237, and when the rod 255 later releases this opening force, it allows the suction valve 237 to close under the influence of the suction valve spring 235, chamber pressure or both during the discharge stroke of the pump 202.

In one or more embodiments, the operation of the valve train 250 may be timed using a feedback signal from one or more sensors 126. The one or more sensors 126 may be coupled, directly or indirectly, to the pump 202 at one or more locations of the pump 202 and may sense one or more operational parameters of the pump 202. For example, the one or more operational parameters may comprise detection of a pump stroke and pressure. A sensor 126 may detect the pump stroke of pump 202 based on a timing marker 258 and may transmit this information to the control system 124 so that the control system 124 may determine when the plunger 220 has completed a suction stroke, when the plunger 220 has completed a discharge stroke, or when the plunger 220 is in any other one or more positions as appropriate to properly time the activation of the valve train 250 to open, close or both the suction valve 237 according to a given operation, for example, to improve the efficiency of the pump 202 during a well services operation. A sensor 126 may also detect an overpressure condition requiring a stoppage or a power down sequence of the motor 122 and a release of any fluid in pump 202.

During the suction stroke, the suction valve 237 should be open (with the suction valve 237 away from its seat), allowing fluid from the fluid header 260 to enter the chamber 230 through the suction valve 237. The discharge valve 239 of pump 202 would be closed under the influence of discharge valve spring 243 and line pressure during the suction stroke. Pressure in the chamber 230 will vary during suction and discharge strokes depending upon the position of the plunger 220 in the chamber 230 and the amount and type of servicing fluid (and possibly other material) in the chamber 230. During the discharge stroke, the suction valve 237 should generally be closed, preventing fluid in the chamber 230 from exiting via the suction valve 237 so that as pressure in the chamber 230 builds (due to compression by the plunger 220), the discharge valve 239 opens (as the discharge valve spring 243 is compressed away from its seat), and fluid in the chamber 230 is pumped under pressure out the discharge valve 239.

During one or more well servicing operations or other types of operations, it may be necessary, required or part of job plan or workflow to stop instantaneously or substantially instantaneously the pumping of the pressurized well servicing fluid, for example, to prevent or relieve an overpressure condition or event or to allow for one or more testing procedures. The motor 122, for example, an electric motor, may require a power down sequence that stops, brakes, or ramps down the speed of the electric motor gradually to prevent damage to the electric motor, other equipment or the surrounding environment. However, during this power down sequence (which generally is not an instantaneous or substantially instantaneous power stoppage of the motor 122) the pump 202 may continue pumping due to kinetic energy in the motor 122. A pressure control valve assembly 112 may be coupled to the cylinder 253. The pressure control valve assembly 112 may be activated to prevent or throttle the pressurized servicing fluid 214 from being pumped by pump 202 to the wellhead 206 via flow line 222 during such a power down sequence of the motor 122.

In one or more embodiments, a pressure control valve assembly 112 may be communicatively, electrically, mechanically or otherwise coupled to the control system 124 and coupled to the cylinder 253 or valve train 250. The pressure control valve assembly 112 may be activated and deactivated by the control system 124. The pressure control valve assembly 112 may comprise a reservoir 212, for example, a high pressure tank. Reservoir 212 may comprise a pressurized fluid 218. Pressurized fluid 218 may comprise a fluid, a gas or both including, but not limited to, nitrogen, air, hydraulic oil, or any other gas, fluid or both for activation of the cylinder 253. Reservoir 212 couples to pressure control valve 215. Pressure control valve 215 couples to cylinder 253 or valve train 250 via control line 114. Pressure control valve 215 may be resettable or transitionable between an activated state and a deactivated state. In one or more embodiments, pressure control valve 215 is substantially instantaneously resettable.

As illustrated in FIG. 2, pressure control valve assembly 112 may be maintained in a deactivated state which permits the pump 202 to discharge a servicing fluid 214 to a wellhead 206 or a borehole or until a triggering event occurs by control signal 116 of control system 124. In a deactivated state, pressure control valve assembly 112 does not activate via control line 114 the cylinder 253 or valve train 250. A drain or vent 216 may be coupled to pressure control valve 215 to capture any oil, gas, other substance, or any combination thereof expelled from the pressure control valve assembly 112 when the pressure control valve 215 is in a deactivated state. In a deactivated state, the pressure control valve 215 of the pressure control valve assembly 112 couples the drain or vent 216 to the control line 114.

As indicated by the arrow 204, the pressure control valve 215 may be transitioned from a deactivated state to an activated state. For example, a control signal 116 from control system 124 may cause the pressure control valve 215 to transition from the deactivated state or activate such that the reservoir 212 is coupled to the cylinder 253 or the valve train 250 via control line 114. When the pressure control valve 215 is in an activated state, pressurized fluid 218 is permitted to flow or is discharged from the reservoir 212 to the cylinder 253 or valve train 250. The pressurized fluid 218 creates a pressure or force on the rod 255 such that the rod 255 forces the suction valve 237 to open during a suction stroke and remain open during the discharge stroke(s) such that the servicing fluid 214 is not discharged to the wellhead 206. In one or more embodiments, the control system 124 sends a control signal 116 to activate the pressure control valve 215 based, at least in part, on stroke information associated with the pump 202 received from sensor 126. For example, the control system 124, may send a control signal 116 to activate the pressure control valve 215 when a triggering event has occurred and stroke information from the sensor 126 indicates that the plunger 220 has completed a discharge stroke. In one or more embodiments, the control system 124 sends a control signal 116 at any time during any stroke when a triggering event occurs. In one or more embodiments, sensor 126 may be sufficiently powered to activate control signal 116.

Figure 3A:
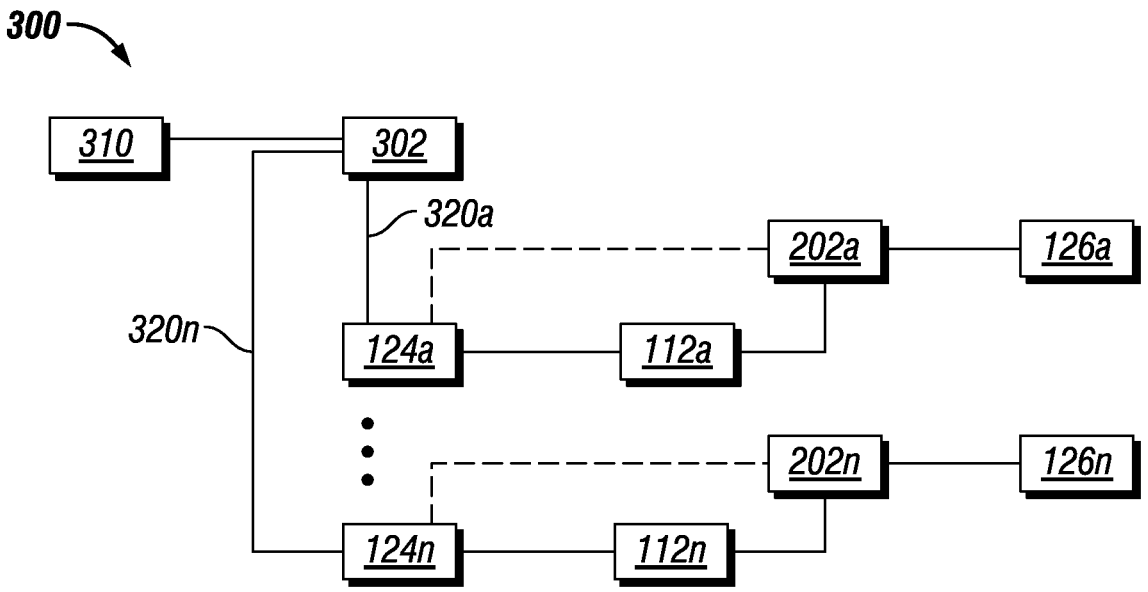
FIG. 3A is a diagram illustrating a controllable pumping system, according to one or more aspects of the present disclosure.

FIG. 3A is a diagram of a controllable pumping system 300, according to one or more aspects of the present disclosure. The controllable pumping system 300 may comprise one or more pumps 202 (for example, pumps 202*a* through 202*n*) as illustrated in FIGS. 1 and 2. Each pump 202 may couple to a pressure control valve assembly 112 (pressure control valve assemblies 112*a* and 112*n*) as illustrated in FIGS. 1 and 2. One or more control systems 124 (control systems 124*a* and 124*n*) may couple to each pressure control valve assembly 112. Each control system 124 may couple to a master control system 302. Master control system 302 may be located local to or remotely from any one or more components of FIG. 3A. A pump 202*a* may be coupled to a valve control assembly 112*a* and a control system 124*a* and a pump 202*n* may be coupled to a valve control assembly 112*n* and a control system 124*n*. Each of the control systems 124*a* and 124*n* may be coupled to the master control system 302. In one or more embodiments, a control system 124 may be coupled to any one or more pressure control valve assemblies 112, pumps 202 or any combination of pressure control valve assemblies 112 and pumps 202. Master control system 302 may be coupled to one or more system sensors 310. System sensor 310 may detect one or more conditions at a site (for example, temperature of any one or more devices, temperature at a site, altitude, wind, rain, barometric pressure, operating state of one or more devices, run-time of any one or more devices, power consumption of any one or more devices, rate of power increase or decrease at any one or more devices, any other condition or combination thereof). Master control system 302 may receive automatically, at a timed interval, or upon request one or more measurements or information from system sensor 310. System sensor 310 may be coupled directly, indirectly, wired or wirelessly to master control system 302. Master control system 302 may transmit a control signal 320 (for example, control signals 320*a* and 320*n*) to one or more control systems 124 to control activation of the pressure control valve assembly 112 based, at least in part, on one or more measurements or information from a sensor 126, a control system 124 or a system sensor 310.

Figure 3B:
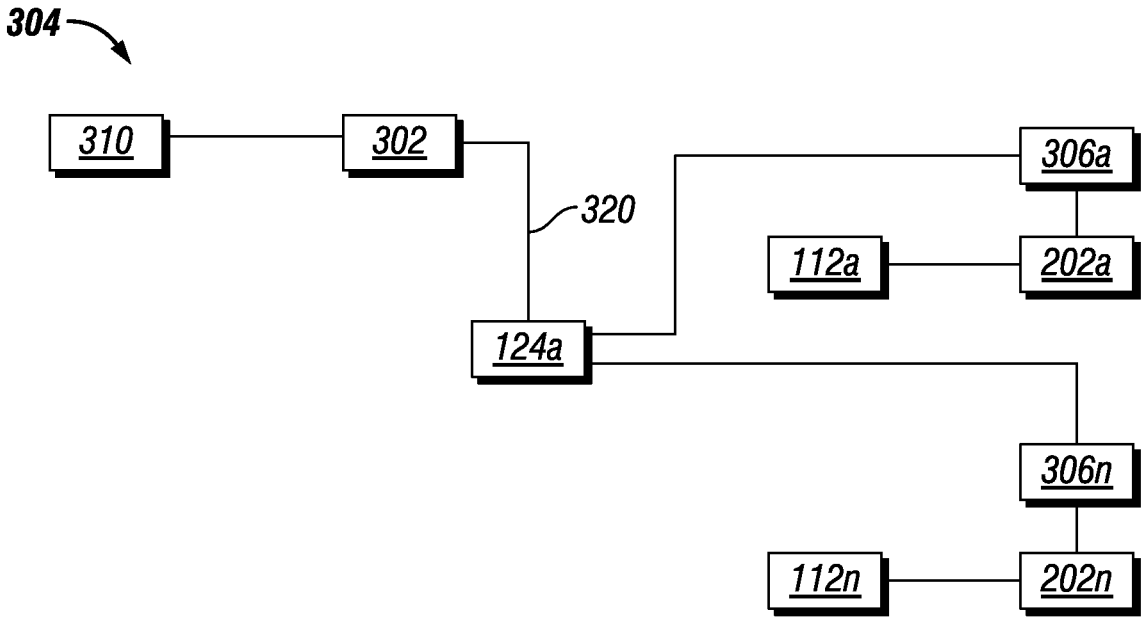
FIG. 3B is a diagram illustrating a controllable pumping system, according to one or more aspects of the present disclosure.

FIG. 3B is a diagram of a controllable pumping system 304, according to one or more aspects of the present disclosure. FIG. 3B is similar to FIG. 3A except each pump 202 (pumps 202*a* and 202*n*) is coupled to an associated control system 306 (control systems 306*a* and 306*n*) for receiving one or more measurements from the associated pump 202, for example, one or more measurements from a sensor 126 associated with a pump 202. Each control system 306 may be coupled to a control system 124 and control system 124 may be coupled to a master control system 302. In one or more embodiments, control system 124 may comprise one or more control systems 124.

Figure 4:
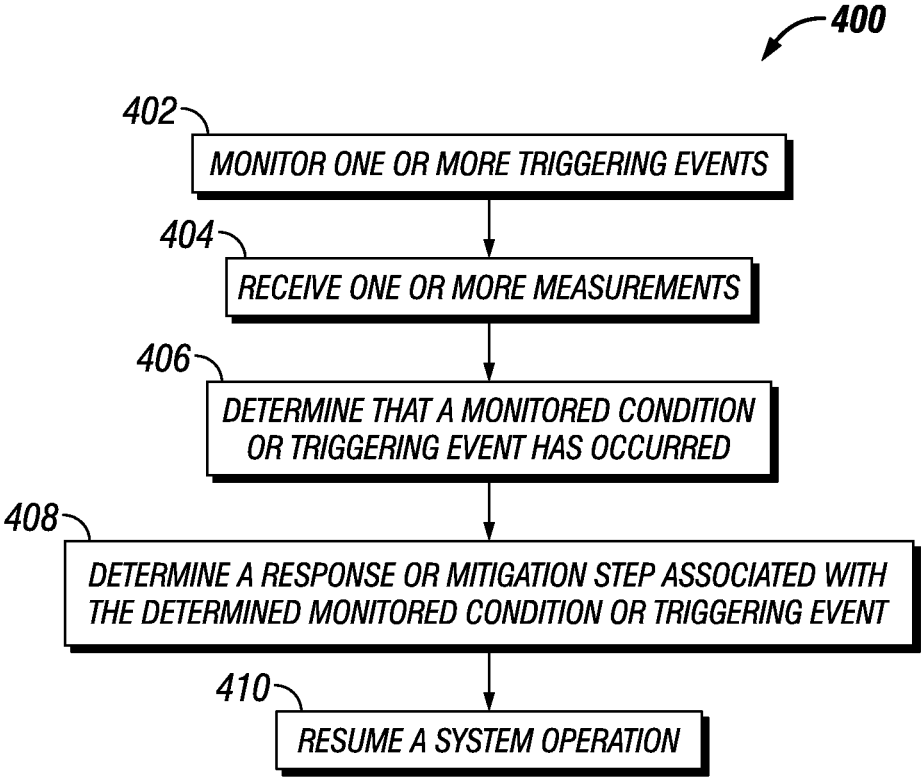
FIG. 4 is a flowchart of a method for pressure limiting for a positive displacement pump, according to one or more aspects of the present disclosure.

FIG. 4 is a flowchart of a method for pressure limiting for a positive displacement pump, according to one or more aspects of the present disclosure. At step 402, one or more triggering events at a site for a configuration of a pumping system 200 are monitored by one or more control systems 124, for example as illustrated in FIG. 1, 2, 3A or 3B. To ensure safety of personnel and to prevent damage to equipment or the surrounding area or environment, one or more conditions or one or more triggering events at a site may be monitored. In one or more embodiments, any one or more triggering events may occur that require a power down sequence of the motor 122 or a response or a mitigation step, such as a reduction or stoppage of flow of servicing fluid 214 from the pump 202 to the wellhead 206 or downhole. For example, one or more triggering events may include, but are not limited to, an overpressure condition (such as an overpressure condition detected by sensor 126), a testing procedure, or any other condition requiring stoppage of pressurized servicing fluid 214 being pumped, for example, to the wellhead 206 or downhole.

At step 404, the master control system 302 or the control system 124 receives one or more measurements or information from a system sensor 310 or a sensor 126. In one or more embodiments, the one or more measurements or information from a system sensor 310 or a sensor 126 is stored in a storage device, such as, a database or a memory located at, within or remote from the master control system 302 or the control system 124.

At step 406, it is determined that a monitored condition or triggering event has occurred. In one or more embodiments, a control system 124 or a master control system 302 (as illustrated in FIGS. 3A and 3B) determines or detects that a triggering event has occurred based, at least in part, on one or more measurements or information received from a sensor 126 associated with a pump 202, a system sensor 310 or any combination of sensors 126 and system sensors 310. For example, one or more measurements or information from a sensor 126 or a system sensor 310 may be indicative of an overpressure condition or that a testing procedure is required. For example, the master control system 302 or the control system 124 may compare the one or more measurements or information from a sensor 126 or a system sensor 310 to a threshold to determine if the one or more measurements or information are indicative of a monitored condition or triggering event. The master control system 302 or the control system 124 may determine that a condition or event has occurred, is about to occur, or is within a margin to occur based, at least in part, on the comparison. For example, the comparison may indicate that a threshold has been reached, not reached, or exceeded or that one or more measurements or information are indicative of a condition or event being within a margin or percentage of the threshold. A threshold may be predetermined or preset. A threshold may be set slightly below or within a margin or percentage of a condition or triggering event. For example, a threshold may be set a certain pounds per square inch (p.s.i.) below an overpressure limit. A threshold may be based, at least in part, one or more ratings for one or more components at a site (such as one or more components of FIGS. 1, 2, 3A and 3B). The one or more ratings may include, but are not limited to, temperature, pressure, run-time, power consumption, rate of power increase or decrease, any other rating, or any combination thereof. For example, an overpressure event may be determined based on a comparison of one or more measurements or information from a sensor 126 or a system sensor 310 indicative of pressure at, on or about one or more devices at a site, for example, a pump 202. In one or more embodiments, input from a user may be indicative of a condition or triggering event. For example, input from a user at the master control system 302 or the control system 124 may trigger an event such that the method continues to step 408.

At step 408, if a condition or triggering event has been detected, then a response or mitigation step is determined. In one or more embodiments, a response may require complete stoppage of all discharge of servicing fluid 214 from each pump 202 to the wellhead 206 or the borehole, selective stoppage of discharge of servicing fluid 214 from at least one or more pumps 202 to the wellhead 206 or borehole, alternating selective stopping of discharge of servicing fluid 214 from at least one or more pumps 202 to the wellhead 206 or borehole, selectively stopping discharge of servicing fluid 24 from one or more pumps 202 to the wellhead 206 or borehole, or any combination of stoppage and starting of discharge of servicing fluid 214 from at least one or more pumps 202 to the wellhead 206 or borehole at any given time, period of time or time interval.

In one or more embodiments, a response to a detection of or a determination that a condition or triggering event has occurred requires selecting a first pump 202*a* based, at least in part, on one or more measurements or information from a sensor 126*a* or a system sensor 310. In one or more embodiments, the one or more measurements or information from a sensor 126*a* or a system sensor 310 may be indicative of an overpressure event at the first pump 202*a* or at the wellhead 206. In one or more embodiments, first pump 202*a* is selected based, at least in part, on one or more ratings associated with first pump 202*a*. In one or more embodiments, a response or mitigation step to the overpressure event may require a decrease or stoppage in discharge of servicing fluid 214 where the decrease or stoppage may be achieved by reduction or stoppage of discharge of servicing fluid 214 from the first pump 202*a* at a first time. In one or more embodiments, the first pump 202*a* is selectively chosen for reduction or stoppage of discharge of a first servicing fluid 214 at a first time and a second pump 202*n* is subsequently, substantially simultaneously or at a timed interval selectively chosen for stoppage or reduction of discharge of a second servicing fluid 214 at a second time. In one or more embodiments, any combination of any one or more pumps 202 may be substantially simultaneously, sequentially, at a timed interval or any other time selectively chosen to stop or reduce discharge of a servicing fluid 214 from any one or more pumps 202, for example, all pumps 202 or any combination of pumps 202 may be selectively chosen. Steps 402-408 may be repeated at any time, timed interval, periodic interval, or otherwise prior to, during or after a condition or triggering event has been detected or determined.

In one or more embodiments, a response or mitigation step may comprise the master control system 302 or the control system 124 initiating a pumping sequence (such as a stoppage) to prevent or throttle the flow of pressurized servicing fluid 214 from any one or more pumps 202 based, at least in part, on detection of a power down sequence of the motor 122 (for example, information from sensor 126 may be indicative of a power down sequence of the motor 122), one or more operator inputs, information from sensor 126 (for example, information from sensor 126 may be indicative of an overpressure condition), a system sensor 310, a flag, alert, semaphore, program instruction or timed interval (for example, testing procedures may be scheduled), or any other indicator.

In one or more embodiments, a response or mitigation step may comprise a power down sequence of one or more motors 122 associated with one or more pumps 202, stoppage or reduction of discharge of servicing fluid 214 from one or more pumps 202 or both. For example, if a power down sequence is required, stoppage of discharge of servicing fluid 214 may also be required as a power down sequence may require a time interval that permits the condition or triggering event to be maintained during the time interval. The master control system 302, the control system 124, or both may be coupled to motor 122 and may send a signal or command (such as via control line 118) to the motor 122 to initiate a power down sequence.

In one or more embodiments, a response or mitigation step may comprise initiating by the master control system 302 or the control system 124 a pumping sequence for the pump 202 to cease, stop, prevent or throttle the flow or discharge of servicing fluid 214 from the pump 202. The master control system 302, the control system 124 or both may receive information from sensor 126 that indicates that the plunger 220 has initiated or begun a suction stroke (causing the suction valve 237 to open). The master control system 302, the control system 124 or both may transmit a signal or a command to the pressure control valve 215 of a pressure control valve assembly 112 to activate the pressure control valve 215. For example, a control signal, such as control signal 116, is sent from the master control system 302 or control system 124 to the pressure control valve 215 to activate or transition the pressure control valve 215 to an activated state from a deactivated stated such that pressurized fluid 218 is flowed from reservoir 218 through pressure control valve 215 into the cylinder 253 to activate (for example, via hydraulic pressure or gas pressure) the rod 255 of cylinder 253. The pressurized fluid 218 causes the rod 255 to extend and engage with the suction valve 237 to maintain the suction valve 237 in an open position, for example, via a hydraulic pressure or a gas pressure. As the suction valve 237 is maintained in an open position during each suction and discharge stroke, any servicing fluid 214 in the pump 202 circulates between the fluid header 260 and the chamber 230 instead of being pumped out flow line 222.

In one or more embodiments, any one or more responses or mitigation steps may comprise activating one or more pressure release valves (not shown), a rupture disc (not shown), or any other pressure relief mechanism.

At step 410, one or more system operations are resumed, automatically restarted, resumed after a timed interval, or otherwise restarted. In one or more embodiments, the master control system 302, the control system 124 or both may automatically or based on a user input deactivate or transition from an activated stated to a deactivated state the pressure control valve 215 to stop the flow of pressurized fluid 218 to the valve train 250 or the cylinder 253, allowing the suction valve 237 to open and close during each stroke so that pressurized well servicing fluid 214 is pumped out flow line 222 to the wellhead 206. Additionally, if a response or mitigation step requires a power down sequence, a power up sequence may be initiated once the condition or overpressure condition has been mitigated prior to, substantially instantaneously with, after, or otherwise deactivating the pressure control valve 215.

While well servicing fluid is discussed with one or more embodiments, the present disclosure contemplates that any type of servicing fluid may be utilized. The present disclosure contemplates that any one or more embodiments are suitable for any one or more types of operations, for example, one or more operations that require instantaneous or substantially instantaneous prevention of throttling of the discharge of a pressurized fluid from a pump.

In certain embodiments, the master control system 302, the control system 124 or both may comprise an information handling system with at least a processor and a memory device coupled to the processor that contains a set of instructions that when executed cause the processor to perform certain actions. In any embodiment, the information handling system may include a non-transitory computer readable medium that stores one or more instructions where the one or more instructions when executed cause the processor to perform certain actions. As used herein, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a computer terminal, a network storage device, or any other suitable device and may vary in size, shape, performance, functionality, and price. The information handling system may include random access memory (RAM), one or more processing resources such as a central processing unit (CPU) or hardware or software control logic, read only memory (ROM), and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

Figure 5:
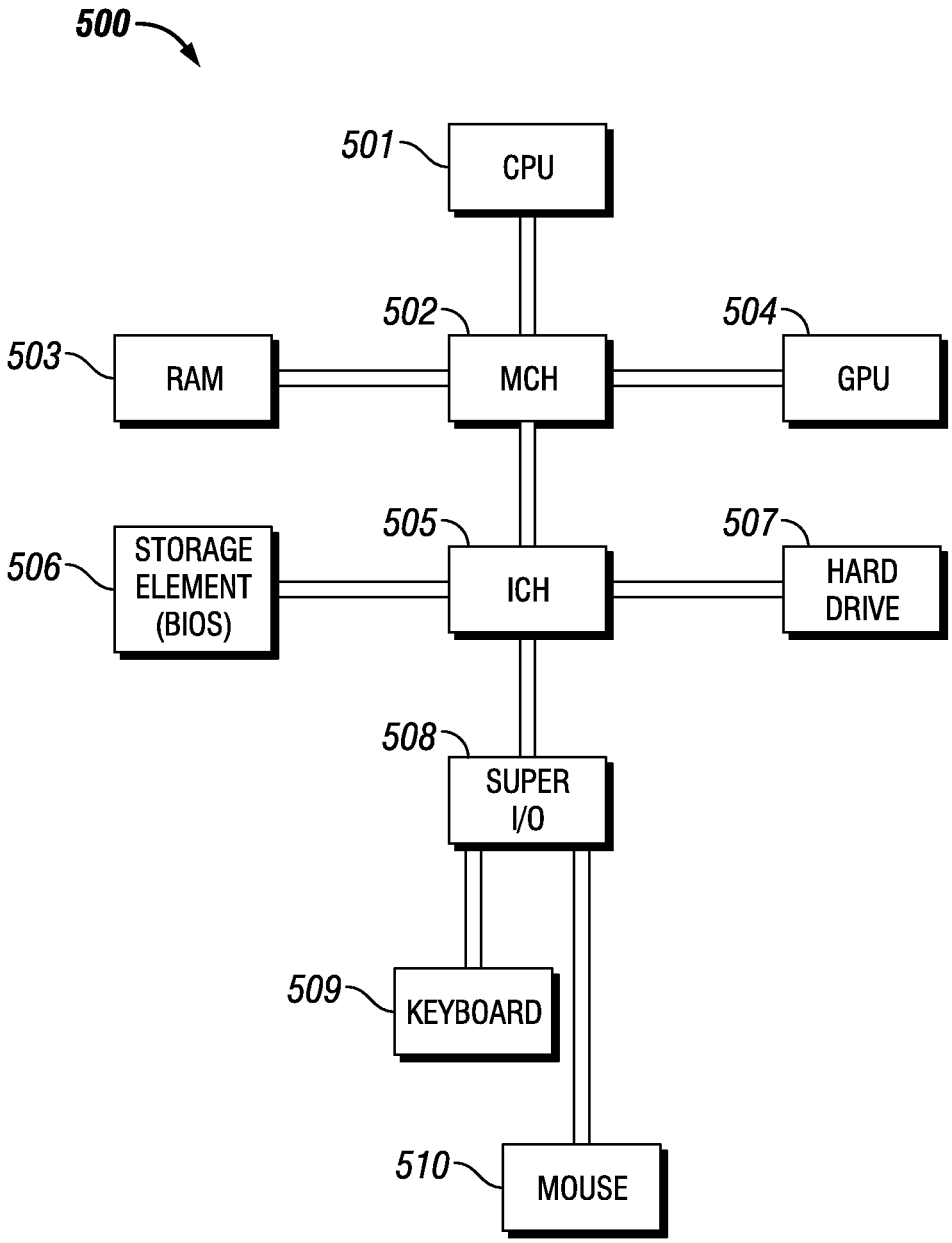
FIG. 5 is a diagram illustrating an example information handling system, according to aspects of the present disclosure.

FIG. 5 is a diagram illustrating an example information handling system 500, according to aspects of the present disclosure. Any one or more of master control system 302, the control system 124 and the control system 306 may take a form similar to the information handling system 500. A processor or central processing unit (CPU) 501 of the information handling system 500 is communicatively coupled to a memory controller hub or north bridge 502. The processor 501 may include, for example a microprocessor, microcontroller, digital signal processor (DSP), application specific integrated circuit (ASIC), or any other digital or analog circuitry configured to interpret and/or execute program instructions and/or process data. Processor 501 may be configured to interpret and/or execute program instructions or other data retrieved and stored in any memory such as memory 503 or hard drive 507. Program instructions or other data may constitute portions of a software or application for carrying out one or more methods described herein. Memory 503 may include read-only memory (ROM), random access memory (RAM), solid state memory, or disk-based memory. Each memory module may include any system, device or apparatus configured to retain program instructions and/or data for a period of time (for example, computer-readable non-transitory media). For example, instructions from a software program or an application may be retrieved and stored in memory 503 for execution by processor 501.

Modifications, additions, or omissions may be made to FIG. 5 without departing from the scope of the present disclosure. For example, FIG. 5 shows a particular configuration of components of information handling system 500. However, any suitable configurations of components may be used. For example, components of information handling system 500 may be implemented either as physical or logical components. Furthermore, in some embodiments, functionality associated with components of information handling system 500 may be implemented in special purpose circuits or components. In other embodiments, functionality associated with components of information handling system 500 may be implemented in configurable general purpose circuit or components. For example, components of information handling system 400 may be implemented by configured computer program instructions.

Memory controller hub (MCH) 502 may include a memory controller for directing information to or from various system memory components within the information handling system 500, such as memory 503, storage element 506, and hard drive 507. The memory controller hub 502 may be coupled to memory 503 and a graphics processing unit 504. Memory controller hub 502 may also be coupled to an I/O controller hub (ICH) or south bridge 505. I/O hub 505 is coupled to storage elements of the information handling system 500, including a storage element 506, which may comprise a flash ROM that includes a basic input/output system (BIOS) of the computer system. I/O hub 505 is also coupled to the hard drive 507 of the information handling system 500. I/O hub 505 may also be coupled to a Super I/O chip 508, which is itself coupled to several of the I/O ports of the computer system, including keyboard 509 and mouse 510.

Figure 6:
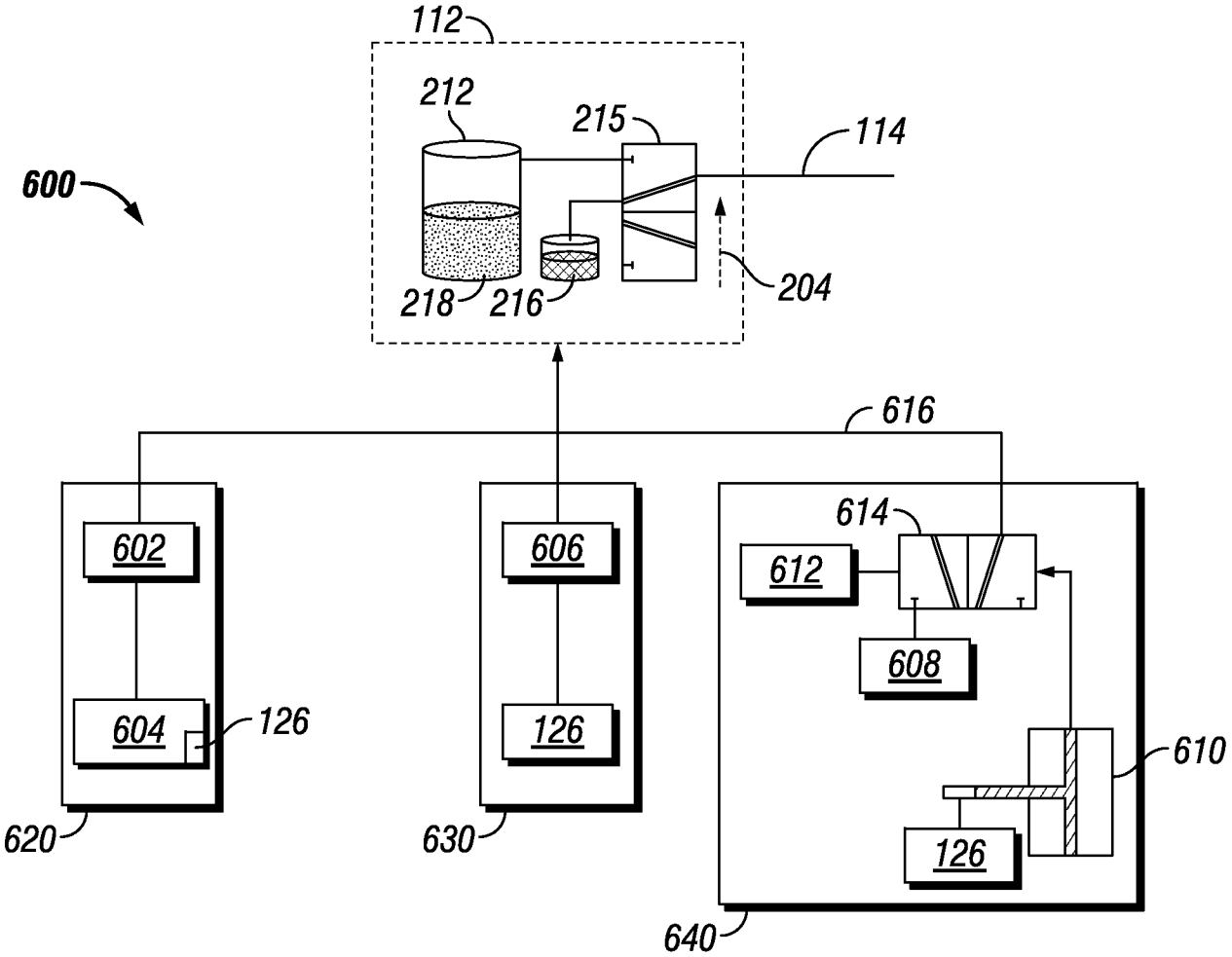
FIG. 6 is a diagram illustrating a controllable pumping system, according to one or more aspects of the present disclosure.

FIG. 6 is a diagram illustrating a controllable pumping system 600, according to one or more aspects of the present disclosure. In one or more embodiments, in addition to a pressure control valve assembly 112 that is selectively and automatically controllable by a master control system 302 and a control system 124, for example, as illustrated in FIGS. 1, 2, 3A and 3B, one or more additional control mechanisms may be used to activate or transition the pressure control valve assembly 112 to an activated state from a deactivated state. In one or more embodiments, a controllable pumping system 600 may comprise a pump 202 coupled to a pressure control valve assembly 112 where the pressure control valve assembly is coupled to any one or more of an on-board pressure control assembly 620, a mechanical switch assembly 630, a pressure reducer assembly 640, any one or more components as illustrated in FIGS. 1, 2, 3A and 3B, or any combination thereof.

In one or more embodiments, on-board pressure control assembly 620 comprises an on-board controller 602, for example an information handling system such as information handling system 500 of FIG. 5, a processor, such as processor 501, a control system, such as control system 124 of any of FIG. 1, 2, 3A, or 3B, any other computing device or any combination thereof. The on-board controller 602 may be disposed on, within or about a pump 202. The on-board controller 602 may receive information or one or more measurements from a pressure detection mechanism 604. Pressure detection mechanism 604 may be disposed on, within, or about a pump 202. Pressure detection mechanism 604 may comprise a sensor 126. The on-board controller 602 may be coupled to pressure control valve assembly 112 communicatively, directly or indirectly, wired, or wirelessly. Based, at least in part, on the one or more measurements from the pressure detection mechanism 604, the on-board controller 602 may transmit a control signal 616 to activate the pressure control valve assembly 112 so as to cease, stop or otherwise prevent servicing fluid, for example, servicing fluid 214, from being discharged from pump 202 according to one or more aspects of the present disclosure. In one or more embodiments, the pressure control valve 215 may comprise a three position valve which usually has a center position that is "plugged" to all flow and requires an active activation and deactivation signal to protect against any accidental erroneous signals.

In one or more embodiments, a mechanical switch assembly 630 comprises a mechanical pressure switch 606 coupled communicatively, directly or indirectly, wired or wireless, to a sensor 126. The mechanical pressure switch 606 may comprises a Barksdale pressure switch, for example. The mechanical pressure switch 606 may be triggered based on one or more measurements from sensor 126. When the mechanical pressure switch 606 is triggered, the mechanical pressure switch 606 may transmit control signal 616 to activate the pressure control valve 112 so as to cease, stop or otherwise prevent servicing fluid, for example, servicing fluid 214, from being discharged from pump 202 according to one or more aspects of the present disclosure.

In one or more embodiments, a pressure reducer assembly 640 comprises a sensor 126 coupled communicatively, directly or indirectly, wired or wirelessly to a deintensifier 610. The deintensifier may be coupled to a pressure control valve 614 (similar to a pressure control valve 215 of FIG. 2). The pressure control valve 614 may be coupled to a reservoir 608 containing or comprising a pressurized fluid, for example a pressurized fluid similar to pressurized fluid 218. A regulated air pressure tank 612 may be coupled to pressure control valve 614 to provide or define a set pump pressure. The pressure control valve 614 is activated based, at least in part, on the pump pressure defined by the regulated air pressure tank 612 and the one or more measurements received by the deintensifier 610 from sensor 126. When the pressure control valve 614 is activated, the pressurized fluid from the reservoir 608 is flowed to the pressure control valve assembly 112 to activate the pressure control valve assembly 112.

In one or more embodiments, a pump pressure limiting system comprises a pump, wherein the pump comprises a suction valve through which fluid is drawn into a chamber during a suction stroke and a valve train having a cylinder with a rod that interacts with the suction valve, wherein activation of the rod disables operation of the pump by keeping the suction valve open, and a pressure control valve assembly, wherein the pressure control valve assembly comprises a pressure control valve coupled to the valve train, wherein the pressure control valve is transitionable between an activated state and a deactivated state. In one or more embodiments, the pump pressure limiting system further comprises a reservoir having a pressurized fluid coupled to the pressure control valve; wherein the pressurized fluid fluidically couples to the cylinder via the pressure control valve to extend the rod to maintain the suction valve in an open position to prevent or throttle discharge of a fluid from the pump when the pressure control valve is in the activated state. In one or more embodiments, the pump pressure limiting system further comprises a control system coupled to the pressure control valve, a sensor coupled to the pump and the control system and wherein the control system transitions the pressures control valve to the active state based, at least in part, on one or more measurements received from the sensor. In one or more embodiments, the pump pressure limiting system further comprises a system sensor coupled to the control system, wherein the control system transitions the pressure control valve to the active state based, at least in part, on one or more measurements received from the system sensor. In one or more embodiments, the control system comprises a master control system coupled to one or more control systems. In one or more embodiments, the control system couples to a plurality of pumps. In one or more embodiments, the servicing fluid is a well servicing fluid.

In one or more embodiments, a method for preventing or throttling discharge of a servicing fluid from a pump comprises monitoring a site for one or more triggering events, determining an occurrence of at least one of the one or more triggering events, activating a pressure control valve coupled to a valve train of the pump based, at least in part, on the determination of the occurrence of the at least one of the one or more triggering events, flowing pressurized fluid from the pressure control valve to the valve train, maintaining a suction valve of the pump in an open position based, at least in part, on the pressurized fluid and throttling or preventing discharge of the servicing fluid from the pump based, at least in part, on the flowed pressurized fluid. In one or more embodiments, the method further comprises receiving one or more measurements from a sensor coupled to the pump, wherein the determination of the occurrence of the at least one of the one or more triggering events is based, at least in part, on the received one or more measurements. In one or more embodiments, the method further comprises extending a rod of a cylinder of the valve train, wherein the cylinder receives the pressurized fluid, and wherein the extended rod maintains the suction valve in the open position. In one or more embodiments, the method further comprises sensing a suction stroke of a plunger of the pump, wherein the input control valve is activated during the suction stroke. In one or more embodiments, the pump comprises a plurality of pumps. In one or more embodiments, the method further comprises selectively throttling or preventing discharge of the servicing fluid from at least one pump of the plurality of pumps. In one or more embodiments, the selectively throttling or preventing discharge of the servicing fluid from the at least one pump of the plurality of pumps comprises selecting the at least one pump of the plurality of pumps based, at least in part, on a rating. In one or more embodiments, the selectively throttling or preventing discharge of the servicing fluid from the at least one pump of the plurality of pumps comprises selecting a first pump of the at least one pump of the plurality of pumps, throttling or preventing discharge of the servicing fluid from the first pump of the at least one pump of the plurality of pumps at a first time, selecting a second pump of the at least one pump of the plurality of pumps, and throttling or preventing discharge of the servicing fluid from second first pump of the at least one pump of the plurality of pumps at a second time.

In one or more embodiments, a non-transitory computer readable medium storing one or more instructions that, when executed, cause a processor to monitor a site for one or more triggering events, determine an occurrence of at least one of the one or more triggering events, activate a pressure control valve coupled to a valve train of at least one pump of a plurality of pumps based, at least in part, on the determination of the occurrence of the at least one of the one or more triggering events, flow pressurized fluid from the pressure control valve to the valve train, maintain a suction valve of the pump in an open position based, at least in part, on the pressurized fluid and throttle or prevent discharge of the servicing fluid from the at least one pump of the plurality of pumps based, at least in part, on the flowed pressurized fluid. In one or more embodiments, the one or more instructions that, when executed further cause the processor to receive one or more measurements from a sensor coupled to the at least one pump of the plurality of pumps, wherein the determination of the occurrence of the at least one of the one or more triggering events is based, at least in part, on the received one or more measurements. In one or more embodiments, the one or more instructions that, when executed, further cause the processor to at least one of extend a rod of a cylinder of the valve train, wherein the cylinder receives the pressurized fluid, and wherein the extended rod maintains the suction valve in the open position and sense a suction stroke of a plunger of the at least one pump of the plurality of pumps, wherein the input control valve is activated during the suction stroke. In one or more embodiments, the one or more instructions that, when executed, further cause the processor to selectively throttle or prevent discharge of the servicing fluid from the at least one pump of the plurality of pumps. In one or more embodiments, the selectively throttling or preventing discharge of the servicing fluid from the at least one pump of the plurality of pumps comprises selecting a first pump of the at least one pump of the plurality of pumps, throttling or preventing discharge of the servicing fluid from the first pump of the at least one pump of the plurality of pumps at a first time, selecting a second pump of the at least one pump of the plurality of pumps and throttling or preventing discharge of the servicing fluid from second pump of the at least one pump of the plurality of pumps at a second time.

The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee.

What is claimed is:

1. A pump pressure limiting system, comprising:

a pump, wherein the pump comprises:

a suction valve through which a servicing fluid is drawn into a chamber during a suction stroke; and a valve train having a cylinder with a rod that interacts with the suction valve, wherein activation of the rod disables operation of the pump by keeping the suction valve open; and a pressure control valve assembly, wherein the pressure control valve assembly comprises:

a pressure control valve coupled to the valve train, wherein the pressure control valve is transitionable between an activated state and a deactivated state; and a reservoir having a pressurized fluid coupled to the pressure control valve, wherein the pressurized fluid fluidically couples to the cylinder via the pressure control valve to extend the rod to maintain the suction valve in an open position to prevent or throttle discharge of the servicing fluid from the pump when the pressure control valve is in the activated state such that the pressurized fluid flows from the reservoir through the pressure control valve into the cylinder.

2. The pump pressure limiting system of claim 1, further comprising:

a control system coupled to the pressure control valve;

a sensor coupled to the pump and the control system; and wherein the control system transitions the pressure control valve to the activated state based, at least in part, on one or more measurements received from the sensor.

3. The pump pressure limiting system of claim 2, further comprising a system sensor coupled to the control system, wherein the control system transitions the pressure control valve to the active state based, at least in part, on one or more measurements received from the system sensor.

4. The pump pressure limiting system of claim 2, wherein the control system is coupled to a master control system that is also coupled to one or more other control systems.

5. The pump pressure limiting system of claim 2, wherein the control system couples to a plurality of pumps.

6. The pump pressure limiting system of claim 1, wherein the servicing fluid is a well servicing fluid.

7. A method for preventing or throttling discharge of a servicing fluid from a pump, comprising:

monitoring a site for one or more triggering events;

determining an occurrence of at least one of the one or more triggering events;

activating a pressure control valve coupled to a valve train of the pump based, at least in part, on the determination of the occurrence of the at least one of the one or more triggering events;

flowing pressurized fluid from a reservoir through the activated pressure control valve to the valve train;

maintaining a suction valve of the pump in an open position based, at least in part, on the pressurized fluid; and throttling or preventing discharge of the servicing fluid from the pump based, at least in part, on the flowed pressurized fluid.

8. The method as claimed in claim 7, further comprising receiving one or more measurements from a sensor coupled to the pump, wherein the determination of the occurrence of the at least one of the one or more triggering events is based, at least in part, on the received one or more measurements.

9. The method as claimed in claim 7, further comprising extending a rod of a cylinder of the valve train, wherein the cylinder receives the pressurized fluid, and wherein the extended rod maintains the suction valve in the open position.

10. The method as claimed in claim 7, further comprising:

sensing a suction stroke of a plunger of the pump; and wherein the pressure control valve is activated during the suction stroke.

11. The method as claimed in claim 7, wherein the pump is one of a plurality of pumps.

12. The method as claimed in claim 11, further comprising selectively throttling or preventing discharge of the servicing fluid from at least one pump of the plurality of pumps.

13. The method as claimed in claim 12, wherein the selectively throttling or preventing discharge of the servicing fluid from the at least one pump of the plurality of pumps comprises selecting the at least one pump of the plurality of pumps based, at least in part, on a rating.

14. The method as claimed in claim 12, wherein the selectively throttling or preventing discharge of the servicing fluid from the at least one pump of the plurality of pumps comprises:

selecting a first pump of the at least one pump of the plurality of pumps;

throttling or preventing discharge of the servicing fluid from the first pump of the at least one pump of the plurality of pumps at a first time;

selecting a second pump of the at least one pump of the plurality of pumps; and throttling or preventing discharge of the servicing fluid from second first pump of the at least one pump of the plurality of pumps at a second time.

15. A non-transitory computer readable medium storing one or more instructions that, when executed, cause a processor to:

monitor a site for one or more triggering events;

determine an occurrence of at least one of the one or more triggering events;

activate a pressure control valve coupled to a valve train of at least one pump of a plurality of pumps based, at least in part, on the determination of the occurrence of the at least one of the one or more triggering events;

flow pressurized fluid from a reservoir through the activated pressure control valve to the valve train;

maintain a suction valve of the pump in an open position based, at least in part, on the pressurized fluid; and throttle or prevent discharge of the servicing fluid from the at least one pump of the plurality of pumps based, at least in part, on the flowed pressurized fluid.

16. The non-transitory computer readable medium of claim 15, wherein the one or more instructions that, when executed, further cause the processor to receive one or more measurements from a sensor coupled to the at least one pump of the plurality of pumps, wherein the determination of the occurrence of the at least one of the one or more triggering events is based, at least in part, on the received one or more measurements.

17. The non-transitory computer readable medium of claim 15, wherein the one or more instructions that, when executed, further cause the processor to at least one of:

extend a rod of a cylinder of the valve train, wherein the cylinder receives the pressurized fluid, and wherein the extended rod maintains the suction valve in the open position; and sense a suction stroke of a plunger of the at least one pump of the plurality of pumps, wherein the pressure control valve is activated during the suction stroke.

18. The non-transitory computer readable medium of claim 15, wherein the one or more instructions that, when executed, further cause the processor to selectively throttle or prevent discharge of the servicing fluid from the at least one pump of the plurality of pumps.

19. The non-transitory computer readable medium of claim 18, wherein the selectively throttling or preventing discharge of the servicing fluid from the at least one pump of the plurality of pumps comprises:

selecting a first pump of the at least one pump of the plurality of pumps;

throttling or preventing discharge of the servicing fluid from the first pump of the at least one pump of the plurality of pumps at a first time;

selecting a second pump of the at least one pump of the plurality of pumps; and throttling or preventing discharge of the servicing fluid from second pump of the at least one pump of the plurality of pumps at a second time.

* * * * *